US005942044A

United States Patent [19]

Piguillet

[11] Patent Number: 5,942,044

[45] Date of Patent: Aug. 24, 1999

[54] METHOD AND DEVICE FOR TREATING DUCTS OF THE TYPE USED FOR VENTILATION

[75] Inventor: Edouard Jean François Piguillet, Berkel en Rodenrijs, Netherlands

[73] Assignee: Piguillet & Zonen V.O.F., Berkel en Rodenrijs, Netherlands

[21] Appl. No.: 08/930,078

[22] PCT Filed: Apr. 17, 1996

[86] PCT No.: PCT/EP96/01635

§ 371 Date: Jun. 19, 1998

§ 102(e) Date: Jun. 19, 1998

[87] PCT Pub. No.: WO96/36445

PCT Pub. Date: Nov. 21, 1996

[30] Foreign Application Priority Data

May 19, 1995 [NL] Netherlands ..... 1000399

[51] Int. Cl.[6] ..... B08B 9/04

[52] U.S. Cl. ..... 134/21; 134/22.12; 134/24; 134/304; 134/395

[58] Field of Search ..... 134/21, 22.11, 134/22.12, 24; 15/316.1, 304, 395

[56] References Cited

U.S. PATENT DOCUMENTS

| | | | |
|---|---|---|---|
| 2,735,794 | 2/1956 | Pletcher | 134/24 |
| 4,795,495 | 1/1989 | Dobson, Sr. | 134/22.11 |
| 5,109,567 | 5/1992 | Harrison | 134/395 |
| 5,383,975 | 1/1995 | Faxon | 134/22.12 |
| 5,584,093 | 12/1996 | Melendres | 15/304 |
| 5,735,016 | 4/1998 | Allen et al. | 15/304 |
| 5,768,741 | 6/1998 | Leiman et al. | 15/395 |
| 5,814,162 | 9/1998 | Barrett et al. | 134/22.12 |

*Primary Examiner*—Jill Warden
*Assistant Examiner*—Saeed T. Chaudhry
*Attorney, Agent, or Firm*—Jones, Day, Reavis & Pogue

[57] ABSTRACT

A method for cleaning and treating a ventilation duct includes the step of creating a partial vacuum in the duct and propelling a jet nozzle through the duct. The propelling device includes radially extending flexible hollow arms connected to a source of pressurized fluid to keep the nozzle substantially in the center of the duct and propelling the nozzle with the reaction thrust of the pressurized fluid emitting from the hollow arms.

5 Claims, 3 Drawing Sheets

METHOD AND DEVICE FOR TREATING DUCTS OF THE TYPE USED FOR VENTILATION

BACKGROUND OF THE INVENTION

1. Field Of The Invention

The invention relates to a method for treating ducts, for instance cleaning thereof, in particular a duct for ventilation, comprising the steps of:

generating an underpressure in said duct, and propelling a jet nozzle by means of a reaction thrust said nozzle being connected to a source of fluid through a hose or the like.

2. Description Of The Related Art

According to a generally known method for cleaning air conditioning ducts, an underpressure is generated in the duct system an a jet nozzle connected to a source of fluid is transported through the duct. The jet nozzle can be connected for instance to a source of pressurized air. With the powerful air jet accumulated dirt in the duct is loosened and removed from the duct system by means of the underpressure. The jet nozzle is moved forward in the duct for cleaning due to the thrust of the outflowing pressurized air.

Such a jet nozzle is known from EP-A-0 077 562.

In this known method the problem arises that the jet nozzle moves forward lying on the bottom of the duct as a consequence of the own weight of the jet nozzle and the connecting member between the source of fluid and the jet nozzle. This results in loss of efficiency, particularly in ducts of larger diameter. It is moreover difficult in this manner to adequately clean the enclosed corners in rectangular ducts.

SUMMARY OF THE INVENTION

The invention provides a solution herefor in that during moving said jet nozzle, said nozzle is kept roughly in the centre of the cross-sectional area of the duct by said propelling means.

Owing to this step the distance of the walls to the jet nozzle is to a very large degree the same in all directions, so that a considerable efficiency improvement is achieved.

A device for performing the method as stated above comprises a jet nozzle with a rotor part and a stator part and connecting means on the jet nozzle for connection to a source of pressurized fluid and means to propel said jet nozzle by means of a reaction thrust, said device being characterized in that said propelling means are formed by radially protruding flexible hollow arms connected to said source of pressurized fluid. These arms strike with their end part against the wall of the duct and centre the jet nozzle roughly in the centre of the duct. The flexible arms preferably take a hollow form and are connected to the connecting means for the fluid. In this manner pressurized air is for instance also directed through the hollow arms to the corners of the duct, so that a sufficient cleaning takes place there also.

In order to enhance the stability of the central guiding of the jet nozzle, a second set of arms can be arranged as seen in longitudinal direction at a distance from the first arms so that support at differing mutual distance also takes place in longitudinal direction.

From WO 94/19118 is known a method and device for cleaning air ducts wherein a jet nozzle connected to a source of pressurized air is moved through a duct. The displacement occurs by means of a rigid feed tube, wherein during operation the jet nozzle carries out a swinging movement along the inner wall of the pipe. Such a device is not suitable for cleaning rectangular or square ducts. Because of the uncontrolled movement of the jet nozzle it is moreover uncertain during operation whether all wall parts of the pipe are subjected to the cleaning operation.

From U.S. Pat. No. 5,347,677 is known a construction wherein a device for cleaning ducts is used in which a blow-out piece is moved through the duct over wheels or a suitable frame. Air is blown from cleaning elements, wherein the cleaning elements perform a sine-shaped movement through the duct during operation.

U.S. Pat. No. 5,109,567 describes a device for cleaning air ducts, wherein a nozzle with radially protruding arms is rotated in the duct. The nozzle is connected to a hose which is pulled through the duct. Flexible spacers hold the rotating nozzle with the arms at a distance from the walls of the duct for cleaning.

SU-A-919 768 discloses a device which is self-propelling by means of nozzles 5. By changing the angle of inclination of the jet to the walls cleaning quality is improved. This device does not disclose means for keeping the jet nozzle substantially in the middle of the duct to be cleaned.

EP-A-0 274 831 discloses a method for treating the air passage of an air conditioning system by introducing an air-borne mist into the air passage in order to coat the surface of the duct. No means for moving an air jet into the air conditioning system and keeping the jet nozzle substantially in the middle of the duct are disclosed.

The invention is further elucidated with reference to the drawings of embodiments.

DETAILED DESCRIPTION OF THE PREFERRED EMBODIMENT

Figure 5:
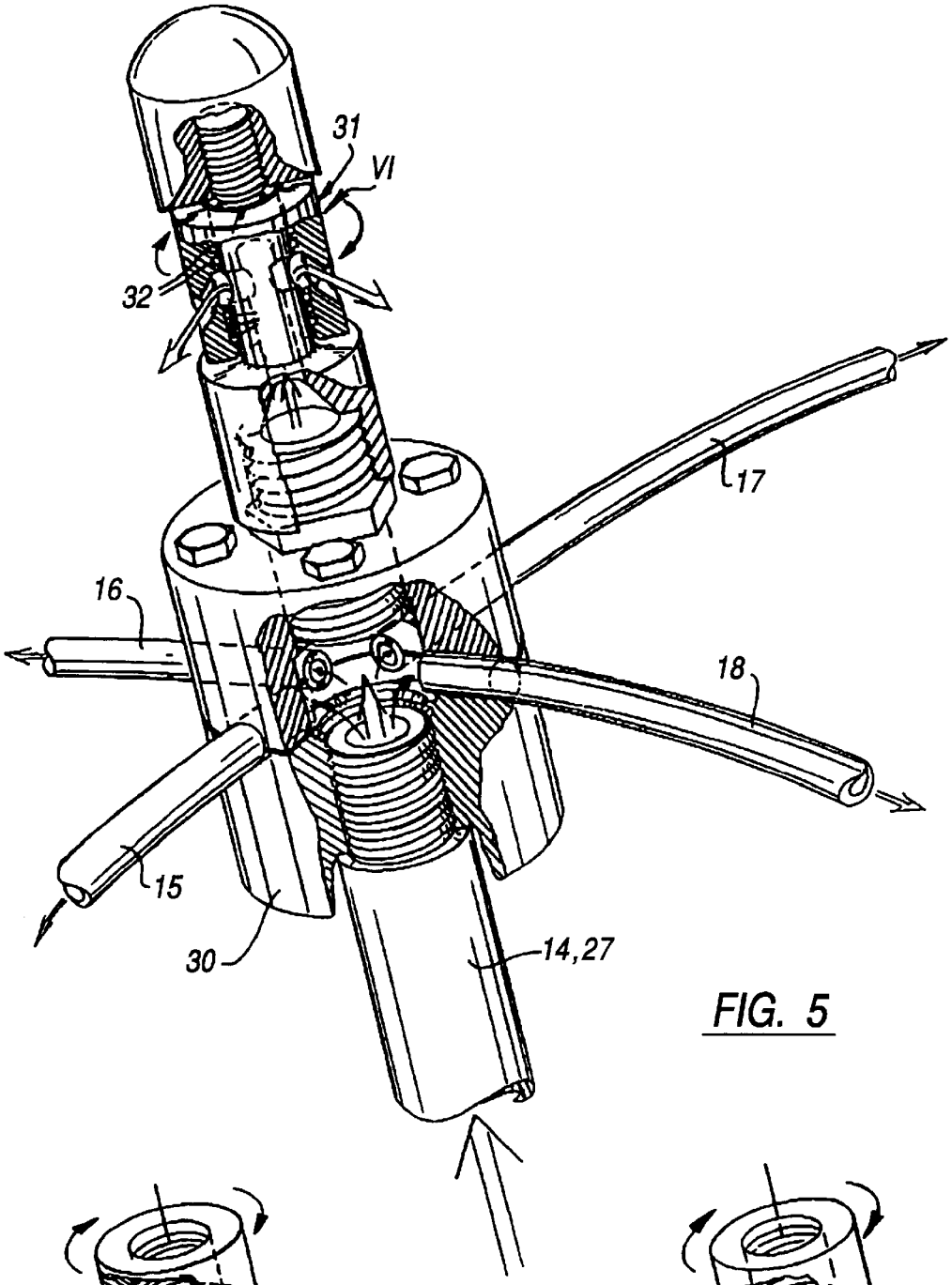
FIGS. 5–7 show in perspective view with cut-away parts embodiments of the jet nozzle according to the invention.

An air duct system 1 for cleaning comprises a main duct 2 and a number of side ducts, for instance 3, 4. Prior to cleaning, the grid in the side ducts is covered with cover foil 5. The closing member 7 in one of the openings of the main duct is also removed and the opening 6 is connected onto an installation 8 for generating underpressure. Connected to this installation is a discharge device 9 for dust 9. The cleaning device 11 is placed into the duct through a second small opening 10 in the main duct 2. The device 11 is connected to a source 12 of pressurized air. The device 11 comprises a jet nozzle 13 which is connected via the flexible hose 14 to the pressurized air source 12. FIG. 5 shows in detail the construction of the jet nozzle.

Figure 1:
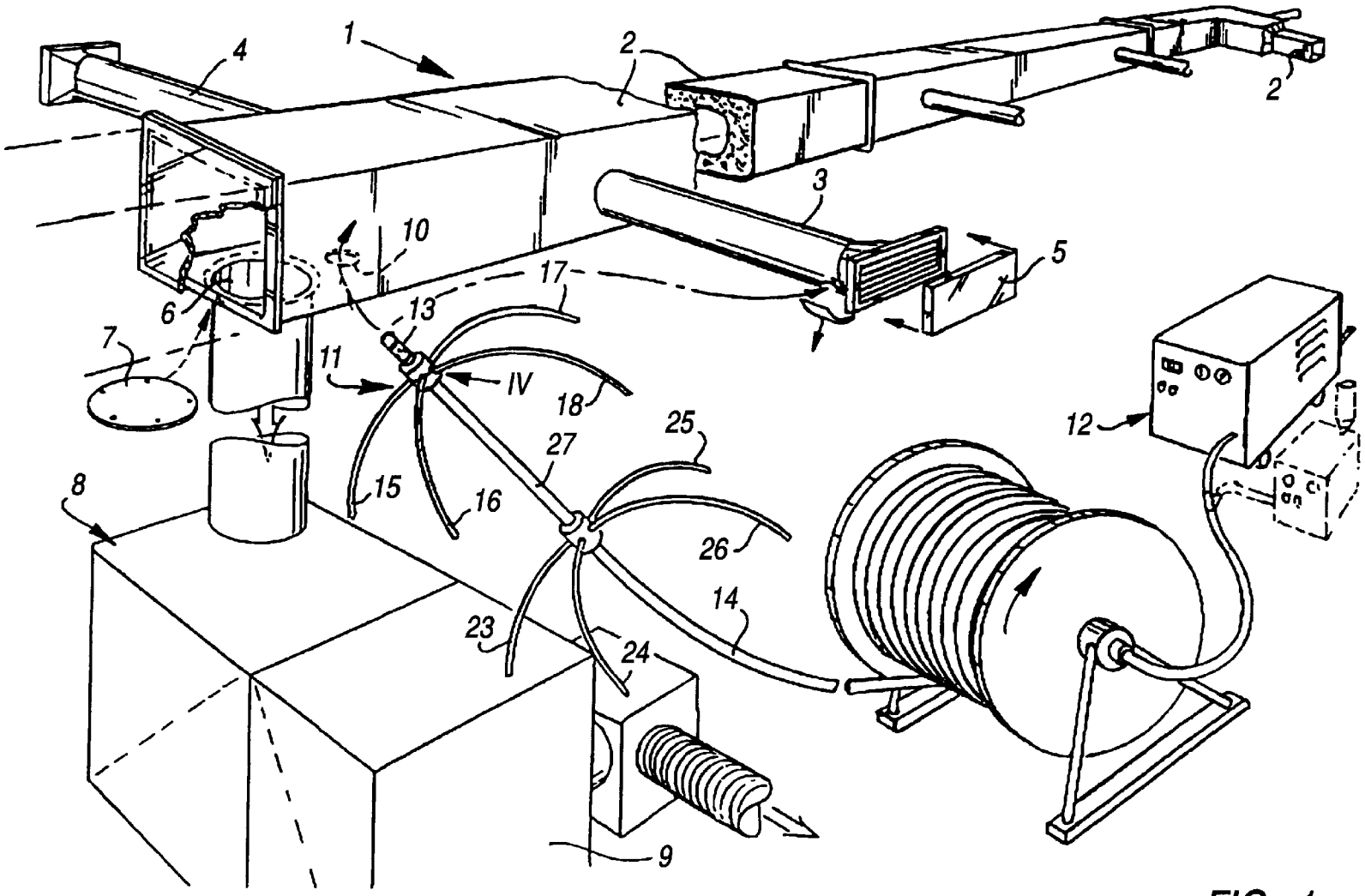
FIG. 1 shows schematically the method according to the invention.
Figure 2:
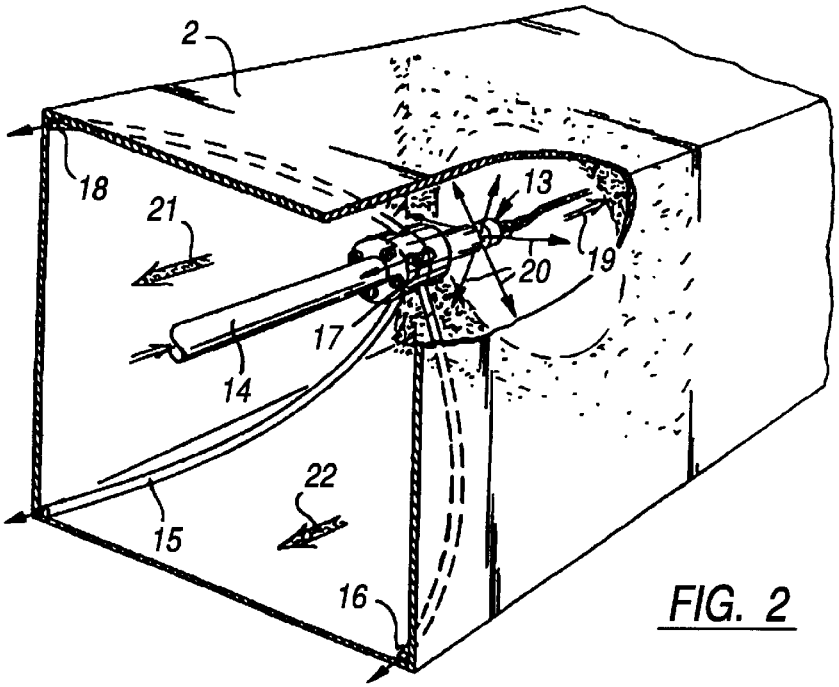
FIGS. 2–4 show details of the method and device according to the invention.
Figure 3:
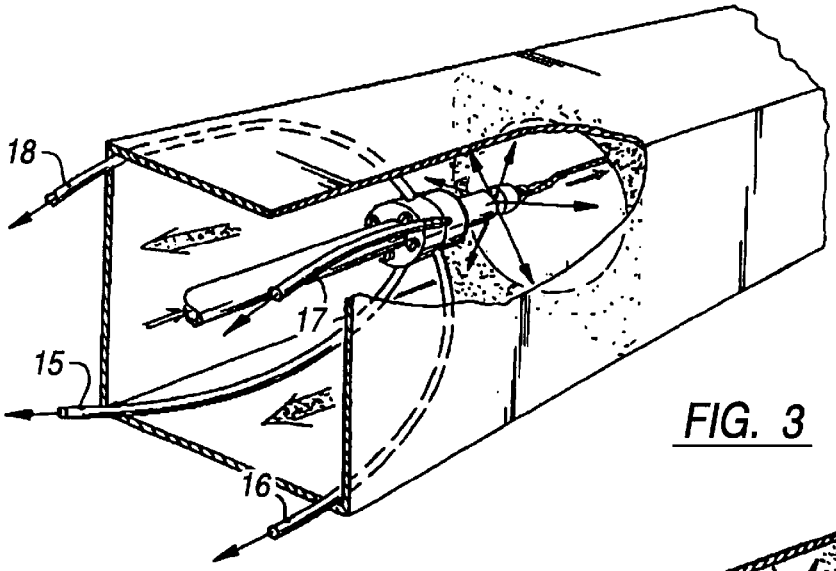
Figure 4:
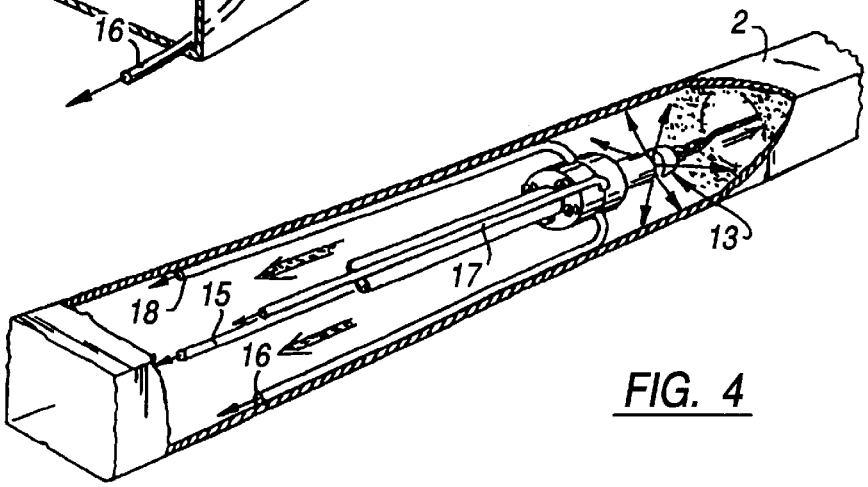

As shown in FIGS. 2–4, the jet nozzle is supported by means of flexible arms 15, 16, 17, 18 such that the jet nozzle 13 is situated roughly in the centre of the duct. Due to the thrust of the outflowing pressurized air the jet nozzle is moved in the direction of the arrow 19. Air jets are emitted radially from the jet nozzle as according to arrow 20, whereby the accumulated dirt in the duct is loosened. Due to the underpressure resulting from the device 8 the dirt is sucked out of the duct to the discharge device 9 in the direction of the arrows 21, 22. The radially protruding arms take a hollow form and are connected to the connecting means of the jet nozzle for fluid under pressure, for instance pressurized air. The corners of the duct are hereby also influenced by the outflowing air and thus cleaned adequately.

FIG. 2 shows a duct of relatively large cross section. FIG. 3 shows a duct of considerably smaller cross section. This results in the arms being bent further than in the duct of FIG. 2.

FIG. 4 shows a duct of very limited cross section.

These embodiments show that in principle ducts with a wide range of inner diameters can be cleaned in this manner.

In order to increase stability still further a second set of radially protruding arms 23, 24, 25, 26 can be arranged at a distance from the first set of arms 15, 16, 17, 18. The two sets are connected by a connecting member 27 of limited flexibility.

It is noted that during withdrawal of the jet nozzle after cleaning, the arms can fold over such that the end parts thereof lie in a direction opposed to the position shown in FIGS. 2–4.

Figure 6:
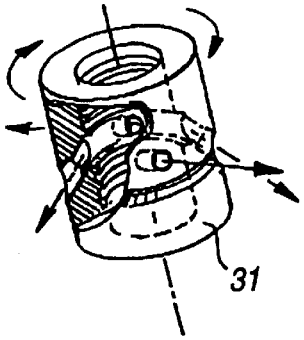
Figure 7:
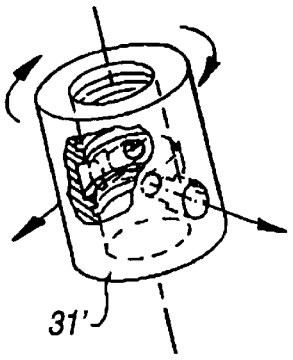

FIG. 5 shows details of the construction of the jet nozzle. The jet nozzle consists of a stationary part 30 and a rotating part 31. Connected to a stationary part 30 are the aforementioned arms 15, 16, 17 and 18. The pressurized air flows in the direction of the arrows through the stator part 30 and the arms 15, 16, 17 and 18. Pressurized air also moves to the rotating part 31. By choosing the inclination of the outflow channels in a suitable manner, the rotor 31 can be provided with a rotating movement. FIGS. 6 and 7 show different directions of the outflow channels. The rotating part can be mounted by means of a water bearing as designated with the reference numeral 32 which indicates a groove-like opening between the relevant parts.

I claim:

1. A method for treating the inside of a duct used for ventilation, comprising the steps of:

generating a pressure in said duct which is lower than ambient pressure, and propelling a jet nozzle through said duct by means of a propelling means said nozzle being connected to a source of fluid, wherein said propelling means are formed by radially protruding flexible hollow arms connected to a source of pressurized fluid to keep the nozzle substantially in the center of said duct and propelling the nozzle with the reaction thrust of the pressurized fluid emitting from said hollow arms.

2. The method as claimed in claim 1, wherein the jet nozzle and said propelling means are both connected to a source of pressurized air.

3. The method as claimed in claim 1, wherein the jet nozzle and said propelling means are both connected to a source of pressurized air and coating material.

4. Apparatus for treating the inside of a duct used for ventilation comprising:

a jet nozzle connected to a source of pressurized fluid; and propelling means connected to a source of pressurized fluid and configured to propel said nozzle through a duct;

wherein said propelling means are formed by radially protruding flexible hollow arms connected to said source of pressurized fluid to keep the nozzle substantially in the center of said duct and propelling said nozzle with the reaction thrust of the pressurized fluid emitting from said hollow arms.

5. Apparatus according to claim 4 wherein said propelling means includes at least two spaced sets of hollow arms.

* * * * *